US007780585B1

(12) United States Patent
Rivas

(10) Patent No.: US 7,780,585 B1
(45) Date of Patent: Aug. 24, 2010

(54) PORTABLE DUAL INCLINE ADJUSTABLE RESISTANCE ABDOMINAL MUSCLE EXERCISE MACHINE

(75) Inventor: Nelson de Jesus Rivas, Yonkers, NY (US)

(73) Assignee: Esperanza Cruz, New York, NY (US)

( * ) Notice: Subject to any disclaimer, the term of this patent is extended or adjusted under 35 U.S.C. 154(b) by 0 days.

(21) Appl. No.: 12/203,918

(22) Filed: Feb. 24, 2009

(51) Int. Cl.
*A63B 26/00* (2006.01)

(52) U.S. Cl. ..... 482/140

(58) Field of Classification Search ..... 482/72, 482/139, 132, 140, 148, 79, 146, 34, 51, 482/70–71, 141
See application file for complete search history.

(56) References Cited

U.S. PATENT DOCUMENTS 4,413,832 A * 11/1983 Pendleton ..... 280/845
4,618,139 A * 10/1986 Haaheim ..... 482/70
4,629,181 A * 12/1986 Krive ..... 482/71
4,679,786 A * 7/1987 Rodgers ..... 482/70
4,743,014 A * 5/1988 Loane ..... 482/71
5,222,928 A * 6/1993 Yacullo ..... 482/71
5,224,909 A * 7/1993 Hamilton ..... 482/70
5,328,427 A * 7/1994 Sleamaker ..... 482/71
5,407,406 A * 4/1995 Canela ..... 482/51
5,499,958 A * 3/1996 Hess ..... 482/79
5,499,961 A * 3/1996 Mattox ..... 482/132
5,503,609 A * 4/1996 Bull ..... 482/70
5,518,483 A * 5/1996 Oswald ..... 482/131
5,518,484 A * 5/1996 Bruckenstein ..... 482/131
5,520,598 A * 5/1996 Little ..... 482/79
5,643,162 A * 7/1997 Landers et al. ..... 482/131
5,697,873 A * 12/1997 Van Straaten ..... 482/126
6,280,366 B1 * 8/2001 Hsieh ..... 482/130
6,368,253 B1 * 4/2002 Harrigan ..... 482/70
6,368,254 B1 * 4/2002 Wall ..... 482/71
6,440,045 B1 * 8/2002 Gaston ..... 482/140
6,514,180 B1 * 2/2003 Rawls ..... 482/70
6,942,605 B1 * 9/2005 Sukhovitsky ..... 482/132
7,134,987 B2 * 11/2006 Goldstein ..... 482/141
7,294,100 B2 * 11/2007 Bull ..... 482/51
7,384,384 B2 * 6/2008 Horvath ..... 482/142
7,419,459 B2 * 9/2008 Van Straaten ..... 482/70
7,455,633 B2 * 11/2008 Brown et al. ..... 482/142

(Continued)

OTHER PUBLICATIONS

U.S. Appl. No. 09/440,546, filed Jan. 16, 2001, Eschenbach, Paul William, p. 2, Line 18.

(Continued)

*Primary Examiner*—Lori Baker

(57) ABSTRACT

An abdominal muscle exercise machine of a push-pull type that includes an elbow sliding support plate with handle bars; a knee sliding support plate with swiveling knee cups; elastic resistance bands attached between the elbow and knee support plates and the end stabilizer bars; parallel sets of shafts at the front and rear end of the machine connected to the sliding support plates; a center rod with support legs to raise it off the ground; quick release clamps attached to the parallel shafts; and end support rods with end caps at the front and rear end of the machine. The machine has a dual incline angle for both the elbows and knees to pull and push against during exercise and may be adjusted in range of motion using quick release clamps. The machine may also be easily folded closed for storing in a compact space.

14 Claims, 6 Drawing Sheets

U.S. PATENT DOCUMENTS

| | | | | |
|---|---|---|---|---|
| 7,470,219 | B2 * | 12/2008 | Larson | 482/54 |
| 7,556,592 | B2 * | 7/2009 | Nizam | 482/70 |
| 2002/0042329 | A1 * | 4/2002 | Nizamuddin | 482/51 |
| 2002/0151417 | A1 * | 10/2002 | List | 482/123 |
| 2003/0216230 | A1 * | 11/2003 | Wang | 482/123 |
| 2004/0053752 | A1 * | 3/2004 | Yang | 482/70 |
| 2004/0077468 | A1 * | 4/2004 | Myles et al. | 482/140 |
| 2004/0087416 | A1 * | 5/2004 | Trenary | 482/51 |
| 2004/0242381 | A1 * | 12/2004 | Parmater | 482/71 |
| 2005/0181917 | A1 * | 8/2005 | Dayal | 482/142 |
| 2005/0266964 | A1 * | 12/2005 | Teng | 482/71 |
| 2006/0189454 | A1 * | 8/2006 | Bull | 482/71 |
| 2006/0211544 | A1 * | 9/2006 | Loane | 482/70 |
| 2006/0287168 | A1 * | 12/2006 | Nizam | 482/71 |
| 2007/0117693 | A1 * | 5/2007 | Ilioi | 482/121 |
| 2007/0179027 | A1 * | 8/2007 | Van Straaten | 482/71 |
| 2008/0200317 | A1 * | 8/2008 | Campanaro et al. | 482/140 |
| 2009/0018000 | A1 * | 1/2009 | Brown et al. | 482/140 |
| 2009/0098988 | A1 * | 4/2009 | Kennedy | 482/140 |
| 2009/0118102 | A1 * | 5/2009 | Larson | 482/51 |
| 2009/0176631 | A1 * | 7/2009 | Blessing | 482/71 |

OTHER PUBLICATIONS

U.S. Appl. No. 09/033,492, filed Jul. 13, 1999, Nestor J. Palacioos.
U.S. Appl. No. 10/640,481, filed Feb. 28, 2006, Ray Trotter.

* cited by examiner

PORTABLE DUAL INCLINE ADJUSTABLE RESISTANCE ABDOMINAL MUSCLE EXERCISE MACHINE

FIELD OF THE INVENTION

This invention relates to the field of abdominal muscle exercise apparatus. More particularly, the present invention relates to an exercise machine that uses a dual incline with elastic bands to create an adjustable resistance push-pull exercise targeted specifically to building the abdominal muscle group in a kneeling position.

BACKGROUND OF THE INVENTION

Exercising the abdominal muscle group has been traditionally performed either with or without the assistance of an apparatus. The common "sit up" or abdominal crunch is performed by laying down flat on the floor with knees bent and facing up. The weight of the upper torso is used as resistance to contract the abdominal muscles during raising the upper torso until the elbows make contact with the knees. Although performing abdominal exercise without machine assistance may be beneficial, it may also cause damage to the body if not performed correctly. Further, the effectiveness of the exercise also varies depending on the techniques used without machines. Consequently, physical fitness trainers realized that exercising the abdominal muscles could be made much more efficient and effective if assisted with a machine.

There are several well known advantages of using machines to assist in abdominal muscle exercise. One advantage is that a well designed exercise machine may reduce the risk of inadvertent strain damage to other muscle groups, specifically lower back strain which is the most common muscle group damaged by strain during abdominal muscle exercise. A second advantage of using abdominal exercise apparatus is to ensure that the abdominal muscles are efficiently exercised during every repetition by keeping the motion of the body in a uniform, consistent and effective range of motion to maximize workout efficiency.

A third advantage of using an assisting machine is that as the user becomes more physically fit he may add additional mechanical resistance during his workout to make the abdominal muscles work even harder during the exercise. The resistance of a machine of course may also be reduced on the same machine for the opposite effect. For example, when the user is just beginning an exercise regimen after a period of inactivity, the user may want to start out the exercise with little or no extra resistance so as to avoid overworking the abdominal muscles until strength has been built up.

Abdominal muscle exercise equipment commonly used in physical fitness centers today range in complexity from basic static inclined benches with adjustable inclination angle that hold the feet locked together to more complex machines that have one or more moving components that assist in maintaining a uniform and consistent range of motion. The group of dynamic abdominal exercise machines of prior art are commonly referred to as "push-pull" devices because they require the user to first pull his elbows and knees together during abdominal muscle contraction followed by a pushing apart of the elbows and knees to return to a relaxed abdominal muscle condition.

There are several common problems that have been observed by this inventor in the current state of the art of abdominal exercise machines. The first problem is that abdominal exercise machine designs are normally not designed to be portable. Common abdominal exercise machine designs are made from large heavy welded square tubing and are often rigidly mounted into even larger exercise stations. A second common problem observed is those most abdominal exercise machines are not affordable for the average consumer to purchase for home use. As a result, most people who use abdominal exercise machines do not have their own machine for home use but instead spend money at fitness centers and use shared abdominal exercise machines at fitness centers. A further common problem with exercise machines shared in fitness centers is poor hygienic upkeep caused by users throughout the day who do not properly clean off their sweat from the machines after use.

A third common problem is that current abdominal exercise machine designs do not provide adequate fixed support for the knees and elbows throughout the entire range of motion during each exercise repetition. One byproduct of the lack of fixed support of knees and elbows is that users can cheat during their workouts by decreasing the range of movement when doing multiple repetitions. A fourth problem seen is that most abdominal exercise machines typically do not allow the user to easily adjust the resistance of the machine during exercise. Those machines seen in the current state of the art that do have variable resistance often use bulky rectangular pinned plate and cable pulley designs that are bulky, lack portability and are furthermore too expensive to purchase for the average person. A fifth problem in the current art is that the adjustment of the range of motion is typically made difficult through the use of bulky components such as shear pins.

This invention solves or ameliorates these problems noted in the current state of the art by providing an abdominal muscle exercise machine that is designed to be portable and inexpensive to purchase while further providing a highly efficient and controlled range of motion including the capability of variable machine resistance against the pushing and pulling work done during each exercise motion.

BRIEF SUMMARY OF THE INVENTION

It is an object of the present invention to provide an abdominal muscle push pull exercise machine that is portable. The machine has front and rear sections that can be folded closely together by using two hinged collars that rotate around a center circular rod. The hinged collars also are used to fold out the exercise machine during setup for use. The shafts and rods that are used in the construction of the frame are made from stainless steel hollow tubing. The remaining parts are made from other lightweight materials such as rubber and plastic. This allows the machine to be light enough to be carried by a person of average strength.

It is a further object of the invention to provide an abdominal push pull exercise machine that is low cost and affordable compared with existing push pull abdominal exercise machines. The machine is to be fabricated using low cost materials such as tubular stainless steel, rubber, and plastics. To save additional cost on assembly labor, the machine will also be packaged only partially assembled similar to how most low cost furniture and toys are packaged. A further cost savings will be achieved through the use of automated equipment such as injection molding machines for plastic parts and CNC controlled machining centers for the metal components.

It is another object of the invention to provide an abdominal push pull exercise machine that provides fixed support for the knees and elbows. On the upper (hands and elbow section) frame of the machine, a set of padded handle bars are connected to elbow pads that are fixedly mounted on a common block to create a fixed position for the elbows. On the lower (knee section) frame of the machine, a set of padded knee cups are both mounted to a common block. For additional comfort purposes, the knee cups can swivel back and forth 45 degrees from their center point.

It is an additional object of the invention to provide an abdominal push pull exercise machine that enables the user to easily adjust the resistance of the machine during exercise. In a preferred aspect of the present invention, the movement of the elbow and knee platforms provides a fixed degree of resistance due to the angle from the end rods to the center rod on either end. A variable component of resistance is created preferably through the use of elastic bands that can be either added to or removed from brackets located between the end rods and platforms on either end of the machine. In another aspect of the machine small circular weights may be added to posts on either the elbow or knee platforms for additional resistance adjustment.

It is also an object of the invention to provide an abdominal push pull exercise machine that enables the user to easily adjust the range of motion of the machine. In a preferred aspect of the present invention, the range of motion of the elbow and knee bearing blocks can be easily adjusted by using quick release adjustable clamps located on each shafts. Preferably, there are two quick release clamps per shaft which allows for complete adjustment in both the push and pull directions of motion.

DETAILED DESCRIPTION OF THE INVENTION

Figure 1:
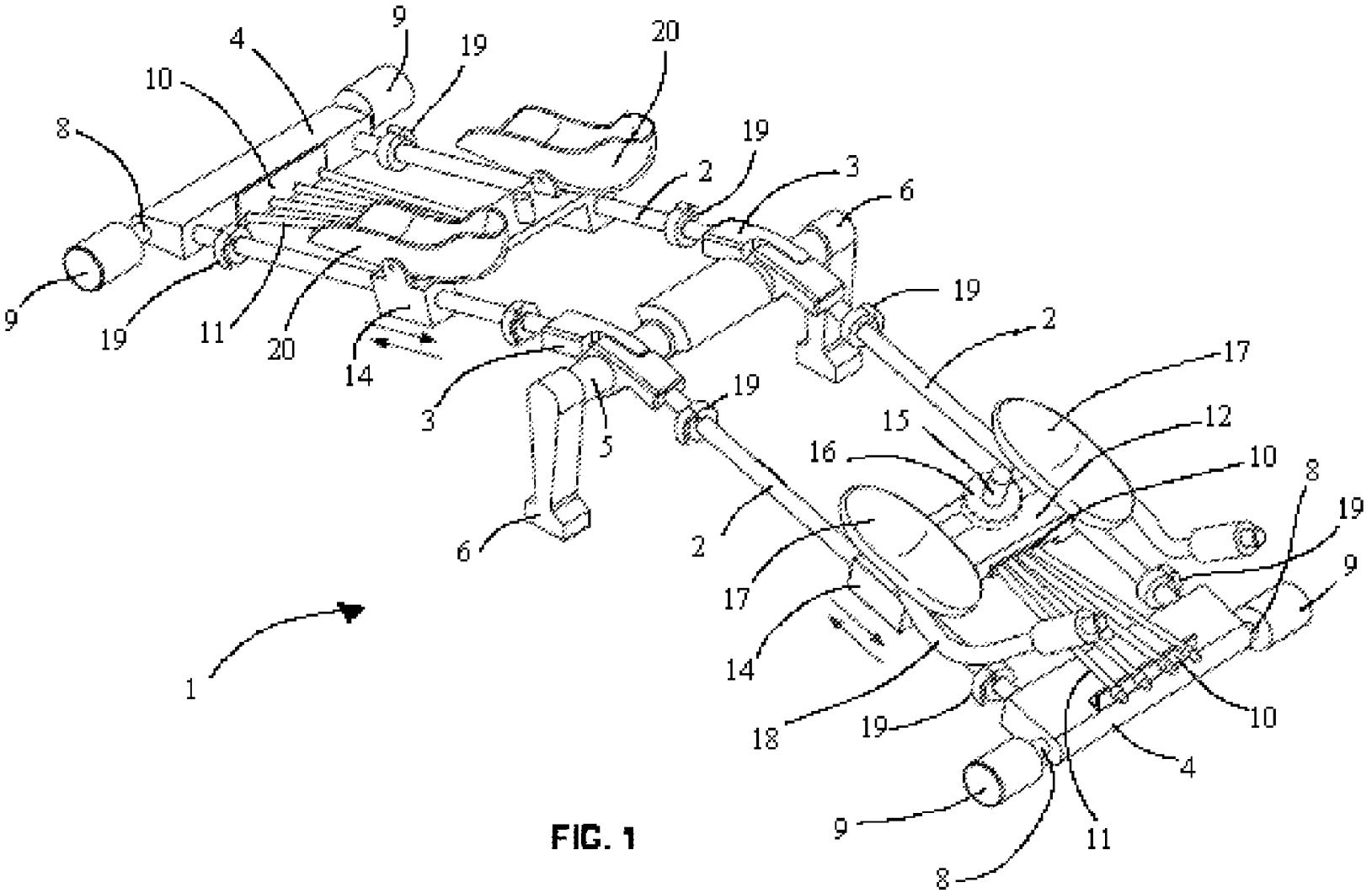
FIG. 1 is an isometric view of the exercise apparatus.
Figure 2:
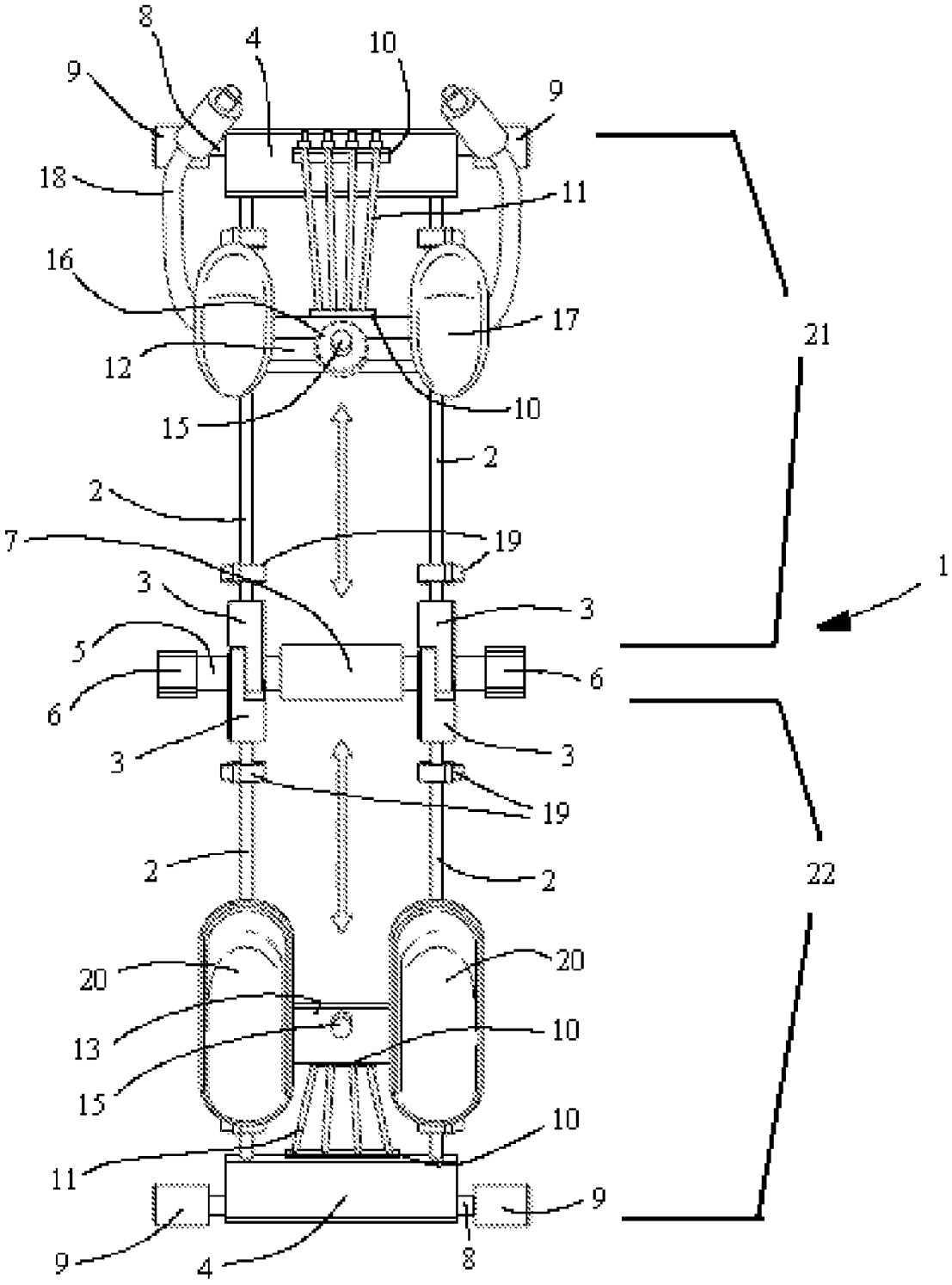
FIG. 2 is a top overhead view of the exercise apparatus with the front or elbow section of the machine shown in the top half of the drawing and the elbow section of the machine shown in the bottom half.
Figure 5A:
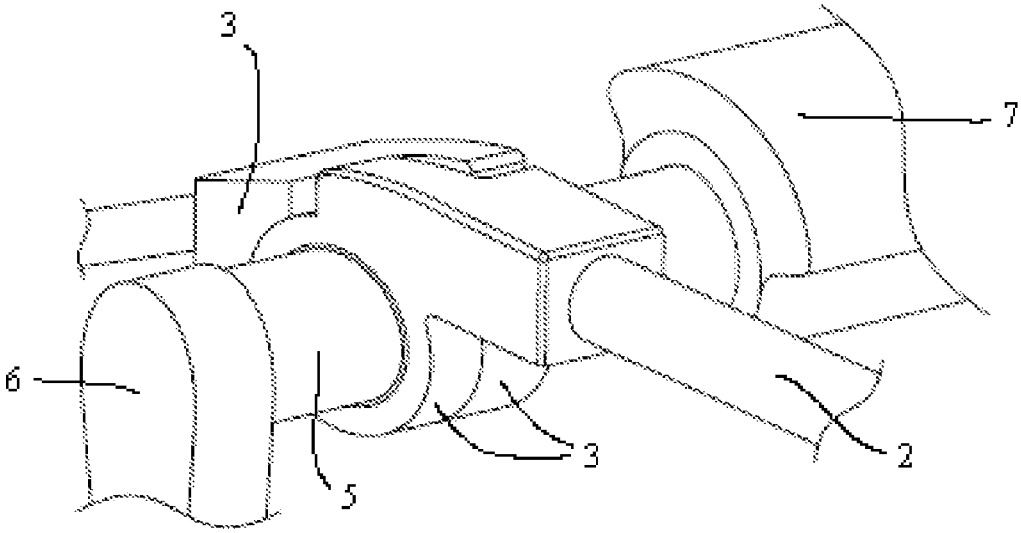
FIG. 5A is a detailed view of a hinged collar mounted concentrically to the center support rod of the exercise machine.

Referring now to the drawings and in particular FIGS. 1 and 2, a preferred embodiment of the portable dual incline variable resistance abdominal muscle exercise apparatus is referred to generally by Reference Arrow 1. Said machine 1 has four steel shafts 2 which are attached at one end to hinge 3 and at the other end to stabilizer bar 4. In the preferred embodiment, hinge 3 has an "L" shape such that the hinges are interlocked together at their inside surfaces when the machine 1 is opened up to its fully extended position as shown in FIG. 5A. All four hinges 3 are mounted to a center support rod 5. Said center support rod 5 is rigidly attached to two support legs 6 at each end. Said support legs 6 are made from a high strength material such as cast iron or steel and are designed to support the weight of the body when in the resting prone position. The support legs 6 are further designed to elevate the center support rod 5 off the ground such that the shafts 2 are declined away from the center support rod 5 at a downward angle towards the stabilizer bars 4.

Referring simultaneously to FIGS. 1 and 2, the center support rod 5 has a soft abdominal cushion pad 7 mounted in the center in order to provide comfort to the abdominal area of the body when resting in the prone position. The stabilizer bars 4 are located at the front and rear end of the exercise machine 1 and are made of a heavy material such as cast iron or steel in order to give stability to the machine. Said stabilizer bars 4 have a hole at the far end through which is located an end support bar 8. Said end support bar 8 has end caps 9 preferably made of a material with a degree of friction such as rubber in order to prevent exercise machine 1 from sliding during movement of the body during exercise. Said front and rear stabilizer bars 4 both have attached on their upper surfaces a resistance band mounting bracket 10. Said mounting bracket 10 contains a plurality of mounting slots to which a plurality of resistance bands 11 may be secured to.

Referring simultaneously to FIGS. 1, 2, 5B, and 5C, said exercise machine 1 also has four sliding bearing blocks 14 that slide freely over the four steel shafts 2. In the front section of said exercise machine 1, a first pair of bearing blocks 14 is rigidly attached to an upper platform 12. In the rear section of said exercise machine 1, a second pair of bearing blocks 14 is rigidly attached to a lower platform 13. Both upper platform 12 and lower platform 13 have a weight post 15 rigidly attached which can be used to load weights 16 in order to add extra resistance if desired by the user. Both upper platform 12 and lower platform 13 also each have a mounting bracket 10 attached for use in securing said resistance bands 11. Upper platform 12 has two padded elbow cups 17 that support the elbow and forearms during exercising. A pair of padded handle bars 18 is rigidly attached to the top surface of upper platform 12 and is curved upwards in a comfortable gripping position.

Figure 5B:
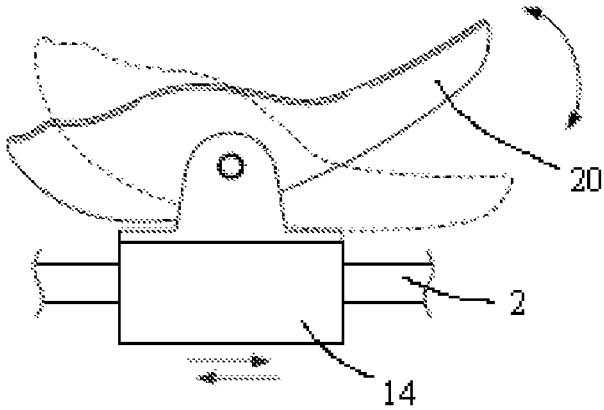
FIG. 5B is a detailed view of a knee support pad and sliding block mount showing the full range of allowed motion of the knee pad.
Figure 5C:
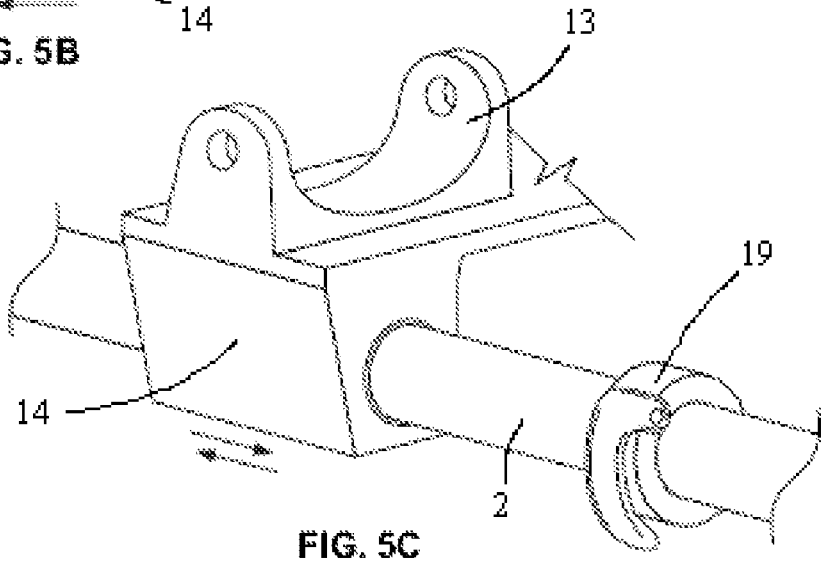
FIG. 5C is a detailed view of a knee support sliding block with the knee pad removed to show a preferred method of mounting of the knee pad to allow limited movement.

Referring simultaneously to FIGS. 1, 2, 5C, and 6, said exercise machine 1 has eight quick release clamps 19 that slide freely over said steel shafts 2. Each quick release clamp 19 may be locked in position on the shaft 2 at any position for the purpose of adjusting the range of motion of the sliding upper and lower platforms 12 and 13 respectively. Exercise machine 1 also has a pair of padded knee cups 20 that are pinned to the lower platform 13 to allow the knee cup 20 to swivel back and forth as shown in FIG. 5B. The swivel motion of the padded knee cup 20 allows for comfort of the user during exercise and further helps avoid blisters on the knees during exercise by preventing the skin of the knees from rubbing against the cup surface during exercise.

Figure 3:
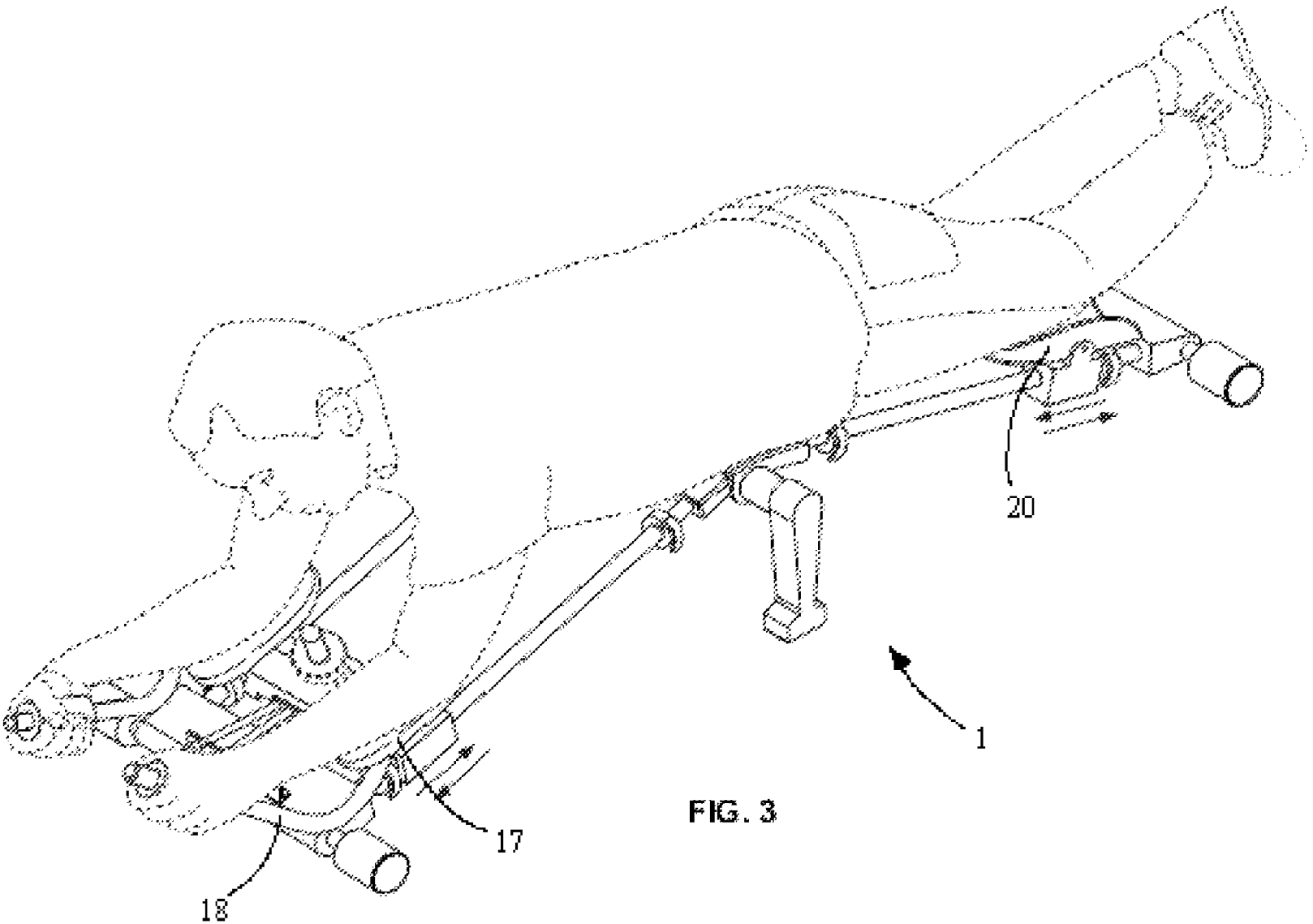
FIG. 3 is an isometric view showing the exercise apparatus with the user in the prone position with hands grasped on the front handle bars and elbows resting on the elbow pads. The knees are shown resting on the knee pads at the rear end of the machine.
Figure 4:
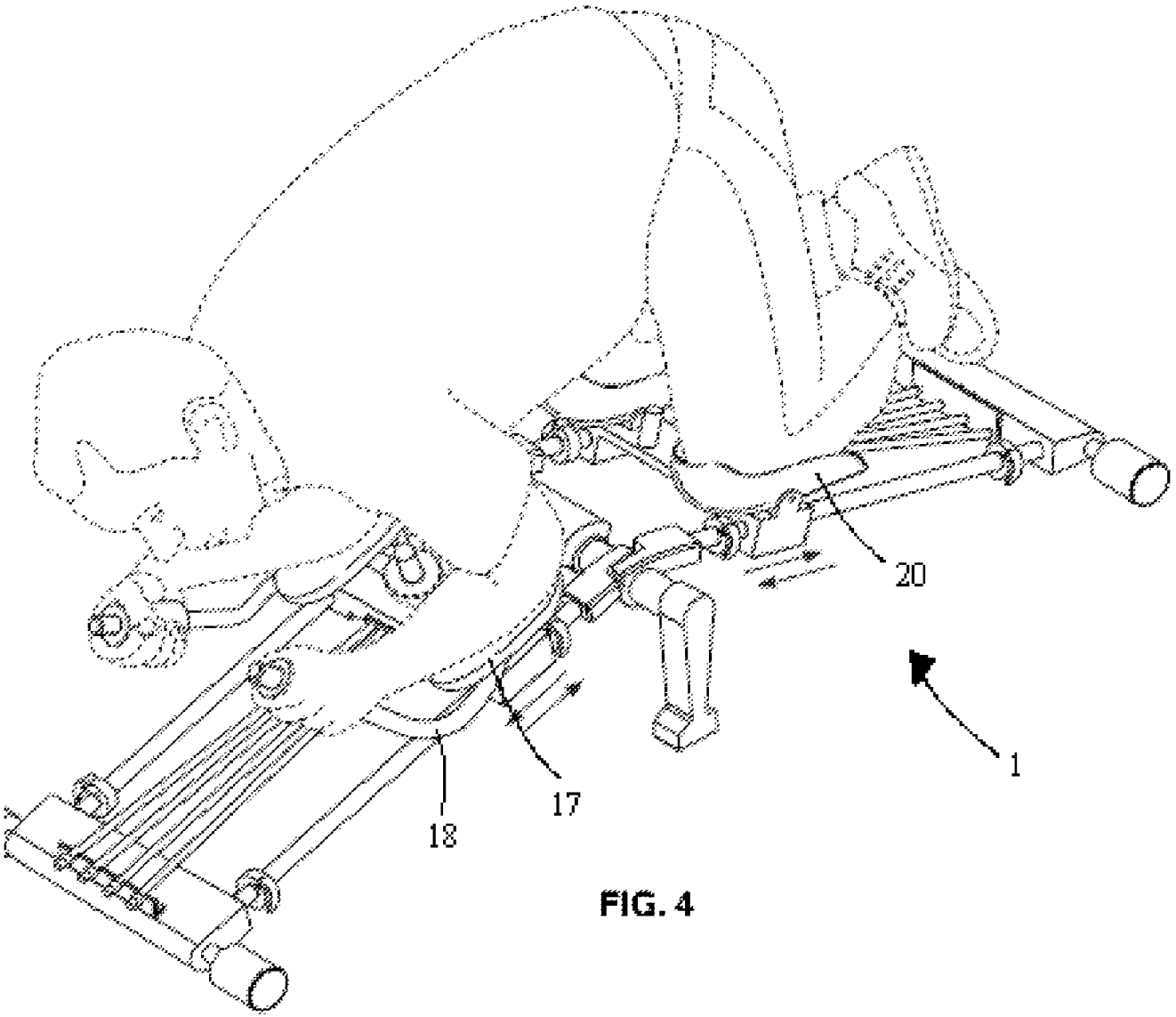
FIG. 4 is an isometric view showing the exercise apparatus with the user in the kneeling position with hands grasped on the front handle bars and elbows resting on the elbow pads. The knees are shown resting on the knee pads at the rear end of the machine.

The exerciser preferably starts out the abdominal exercise by laying face down in a prone position with feet crossed as depicted in FIG. 3. The exerciser preferably grips the padded handle bars 18 while resting the elbows on the padded elbow cups 17. The exerciser places the knees in the padded knee cups 20. The abdominal region of the exerciser, while still in the starting prone position, preferably rests on the abdominal cushion pad 7 shown previously in FIGS. 1 and 2. The abdominal exercise is performed by pulling the elbows and knees together toward the center rod 5 while raising the abdomen up and away from the center rod 5 as shown in FIG. 4. This movement will cause the abdomen muscle group (the rectus abdominis, transverse abdominis, external and internal oblique) to contract. The exerciser then pushes the knees and elbows apart until the body returns to the flat prone position as shown in FIG. 3.

The exerciser may increase the difficulty of the abdominal exercise workout in several ways. In one embodiment, the exerciser may create extra resistance during the pulling together of the elbows and knees by increasing the number of resistance bands 11 used on the machine. In another embodiment, the exerciser may create extra resistance during the pulling together of the elbows and knees by increasing the amount of weights 16 on the upper and lower platforms 12 and 13 respectively. In a third embodiment, the exercise may adjust the positions of the quick release clamps 19 such that the range of motion of the front and rear platforms is extended out to its maximum limit. The pulling of the elbows and knees together while working against dual inclines represents an improvement in the effectiveness of push pull abdominal exercise machine design. The present invention, by having a dual incline design which requires pulling against an incline in both the upper and lower platforms, is a substantial improvement in exercise machine efficiency over the prior art which typically have at most a single inclination angle for the muscles to pull against.

Figure 6:
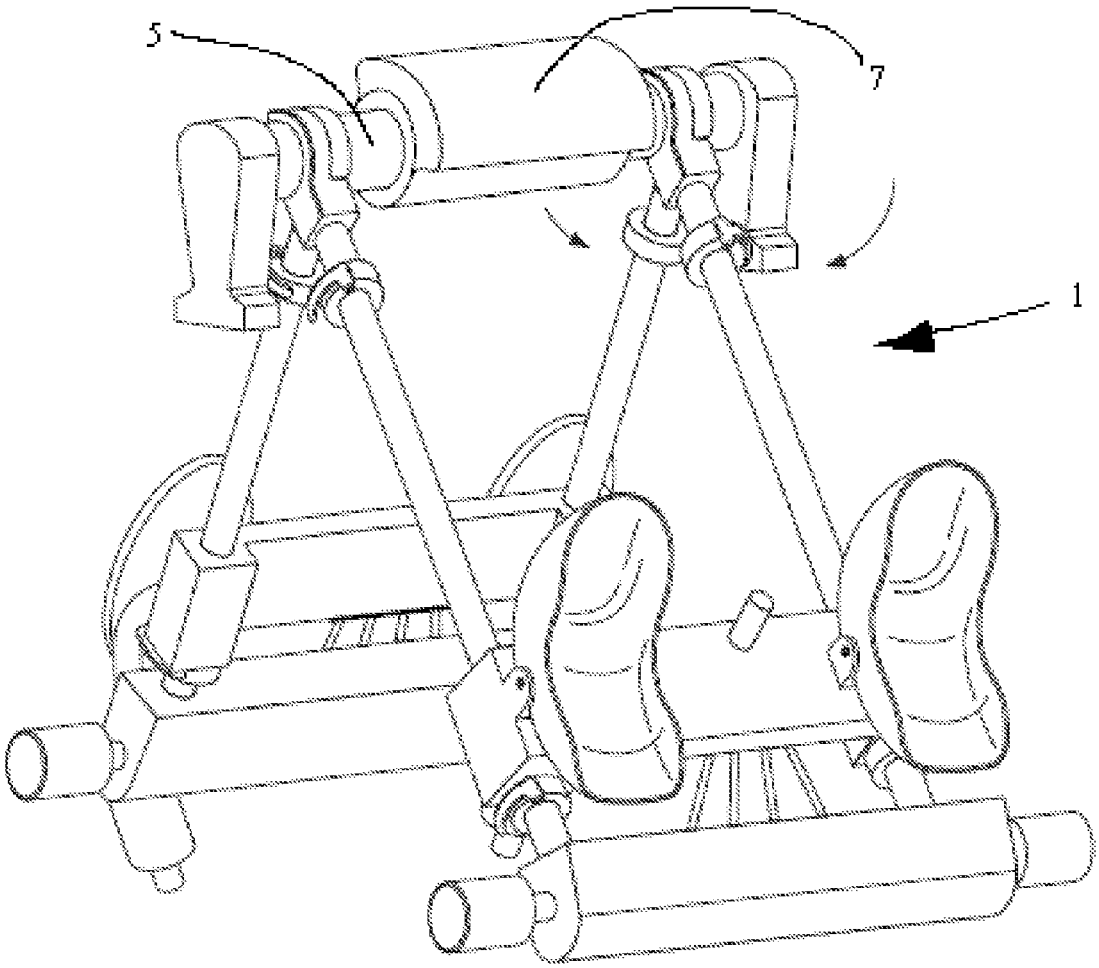
FIG. 6 is an isometric view showing the exercise machine in a folded closed position.

Referring now to FIG. 6, the present exercise machine 1 may be configured for compact storage when not in use. The exercise machine 1 may be folded closed for storage by pulling up on the center rod 5. Pulling upwards on the center rod 5 will cause the upper frame 21 and lower frame 22, which are both hinged to the center rod 5, to come together as shown in FIG. 6. This folded position allows the user to store the machine in a compact storage area such as a closet. By grasping the center rod 5 preferably by cradling the arm under the soft center cushion 7, the folded machine may be comfortably transported by one person of average strength.

The present invention is designed to be affordable for purchase by both owners of fitness centers as well as for personal exercise use in the home. The shafts 2, center rods 5, and end support rods 8, and handle bars 18 may be preferably made from stainless steel tubing. The tubing material must be made of a gauge thickness that is strong enough to support the body weight. Stainless tubing is typically much lower in cost than square welded frame constructions common in the prior art. Further savings in cost may be achieved by using mechanical fasteners such as threaded cap screws to assemble the upper frame 21 and lower frame 22. Because the exercise machine 1 can preferably be packaged in a shipping box in the compact folded together position as shown in FIG. 6, the costs of shipping the exercise machine are also expected to be substantially lower than exercise machines of the prior art.

While the principles of the present invention have been made clear in the above illustrative embodiment, it is expected that those skilled in the art may make further modifications in the components of the invention without departing substantially from those principles. Accordingly, it is intended that the description and drawings be interpreted as illustrative and not in the limiting sense, and that the invention be given a scope commensurate with the appended claims.

I claim:

1. A machine for exercising the abdominal muscle group comprising:

a. two rectangular shaped flat plates, each having a plurality of holes going through said plate that are aligned parallel to each other, b. two cup shaped support pads, each mounted to said first rectangular shaped flat plate, for supporting the elbows of a human while using said machine, c. two cup shaped support pads, each mounted to said second rectangular shaped flat plate, for supporting the knees of a human while using said machine, d. a plurality of elongated rods, each having a diameter that is slightly smaller than diameters of said holes of said rectangular shaped flat plates, for placement through said holes of said rectangular shaped flat plates and also allowing a sliding movement between said rectangular shaped flat plates and said elongated rods, e. a center rod that has a circular cross section and a length of at least twelve inches, f. a plurality of vertical support legs, each at least six inches in length and attached to said center rod, for use in elevating said center support rod off the ground, and g. a plurality of bearings, each having a first hole for concentric alignment with said center rod and a second hole for concentric alignment with said elongated rods.

2. The machine of claim 1 wherein each said elongated rod is rigidly attached to one of said second holes of one of said bearings.

3. The machine of claim 1 wherein said first hole of said bearing is drilled perpendicular to said second hole of said bearing.

4. The machine of claim 1 wherein the angle of inclination formed between the ground and said elongated rods is between five and forty-five degrees.

5. The machine of claim 1 wherein a plurality of anchoring bars are rigidly mounted to said elongated rods for the purpose of securing said machine to the ground.

6. The machine of claim 1 wherein a pair of handle bars are rigidly attached to said first rectangular shaped plate for the purpose of grasping the machine in a prone position by a human.

7. The machine of claim 1 wherein a plurality of elastomeric bands are connected between said anchoring bars and said first and second rectangular shaped plates for the purpose of adding resistance to movement of said rectangular shaped plates during exercise by a human.

8. The machine of claim 1 wherein a cushioned pad made of a soft material is attached to said center support rod for the purpose of resting the abdominal region of a human while using the machine.

9. The machine of claim 1 wherein a plurality of adjustable quick locking clamps are mounted to said elongated rods for the purpose of adjusting the stopping locations of said first and second rectangular shaped plates.

10. The machine of claim 1 wherein two posts, each between one and six inches in length, are mounted to said first and second rectangular shaped plates for the purpose of holding weighted circular discs to add additional resistance to movement during exercise.

11. The machine of claim 1 wherein a plurality of elastomeric foot pads are attached to said anchoring bars for the purpose of creating friction to prevent movement of the exercise machine while being used by a human.

12. The machine of claim 1 wherein there is a first acute angle of inclination formed by said elevated center rod and at least two of said elongated rods pointing at a downward angle towards the ground and a second acute angle of inclination formed by said elevated center rod and at least two of said elongated rods pointing at a downward angle towards the ground.

13. The machine of claim 1 wherein said first rectangular plate slides along said first acute angle of inclination and said second rectangular plate slides along said second acute angle of inclination for the purpose of creating a dual incline exercise motion that improves the efficiency of abdominal muscle exercise by making the muscles of both upper and lower torso work against gravity during exercise by a human on said machine.

14. The machine of claim 1 wherein said bearings have a rectangular shaped recess or pocket on one side for the purposes of forming a mating fit with said bearings on the opposing side of said center rod and also for allowing said machine to be folded together to create a compact storage configuration.

* * * * *